United States Patent [19]

Oohashi

[11] Patent Number: 4,516,558

[45] Date of Patent: May 14, 1985

[54] IGNITION COIL DEVICE FOR INTERNAL COMBUSTION ENGINE

[75] Inventor: Yutaka Oohashi, Himeji, Japan

[73] Assignee: Mitsubishi Denki Kabushiki Kaisha, Japan

[21] Appl. No.: 506,365

[22] Filed: Jun. 21, 1983

[30] Foreign Application Priority Data

Jun. 30, 1982 [JP] Japan ..... 57-115065

[51] Int. Cl.[3] ..... F02P 3/02

[52] U.S. Cl. ..... 123/634; 336/96

[58] Field of Search ..... 123/634, 635; 336/96, 336/98, 180, 182, 184, 212, 216

[56] References Cited

U.S. PATENT DOCUMENTS

| | | | |
|---|---|---|---|
| 1,880,412 | 10/1932 | Burton | 336/184 X |
| 2,418,531 | 4/1947 | Tognola | 336/96 X |
| 2,885,458 | 5/1969 | Hause | 123/635 |
| 3,175,176 | 3/1965 | Henschke | 336/96 X |
| 3,236,937 | 2/1966 | Harkness et al. | 336/96 X |
| 3,448,423 | 6/1969 | Minks | 336/96 |
| 3,888,225 | 6/1975 | Boyer et al. | 123/146.5 X |
| 4,099,510 | 7/1978 | Perrier et al. | 123/634 |

FOREIGN PATENT DOCUMENTS

| | | | |
|---|---|---|---|
| 1538184 | 9/1969 | Fed. Rep. of Germany | 336/96 |
| 56-104162 | 8/1981 | Japan . | |

*Primary Examiner*—Tony M. Argenbright

*Attorney, Agent, or Firm*—Leydig, Voit, Osann Mayer and Holt

[57] ABSTRACT

According to this invention, a coil assembly of an ignition coil device in which a core and primary and secondary coils are unitarily molded by an insulating molding material is provided with a through hole so that the rotary shaft of a distributor or the like in which the ignition coil device is assembled can penetrate through the ignition coil device in a direction perpendicular to the main magnetic fluxes of the coils.

4 Claims, 6 Drawing Figures

IGNITION COIL DEVICE FOR INTERNAL COMBUSTION ENGINE

BACKGROUND OF THE INVENTION

This invention relates to improvements in an ignition coil device for the spark ignitor of an internal combustion engine.

A prior-art device of the specified type has been as shown in FIGS. 1 and 2. Referring to the figures, numeral 1 designates a coil assembly in which a primary coil and a secondary coil are wound in a manner to be insulated from each other and are covered with a molding material. A core 2 forms a magnetic path which is common to the primary coil and the secondary coil wound in the coil assembly 1. Numeral 3 indicates a terminal which is connected to one end of the primary coil, numeral 4 a terminal which is connected to the other end of the primary coil and one end of the secondary coil in common, and numeral 5 a high-voltage terminal which is connected to the other end of the secondary coil. The terminal 3, the terminal 4 and the high-voltage terminal 5 are respectively fastened integrally with the coil assembly 1 by a molding material.

FIG. 3 shows an equivalent circuit of the prior-art device. Here, symbol 1*a* denotes the primary coil, and symbol 1*b* the secondary coil. In addition, FIG. 4 is an electric circuit diagram showing the state of connection during the use of the prior-art device. Referring to FIG. 4, a battery 6 supplies current to the primary coil 1*a* of the ignition coil. An interrupter 7 interrupts the current through the primary coil 1*a* according to the ignition timing of the engine. An ignition plug 8 sparks upon receiving a high voltage which is generated across the secondary coil 1*b* of the ignition coil.

In operation, when the interrupter 7 interrupts the current flowing through the primary coil 1*a* at a predetermined time after the conduction thereof therethrough, the high voltage is induced in the secondary coil 1*b* and is supplied to the ignition plug 8 through the high-voltage terminal 5.

The prior-art ignition coil device is constructed and operated as described above. Therefore, when it is combined with another device such as a distributor having a rotary shaft, a housing for supporting the shaft, etc., it must be arranged so as to avoid the rotary shaft, the housing, etc. This has led to the disadvantage that the whole structure is not balanced and that space is wasted.

SUMMARY OF THE INVENTION

According to this invention, an ignition coil device for an internal combustion engine having a primary coil, a secondary coil and a core for forming a magnetic path common to the coils is characterized in that the core and a coil assembly covering the coils are formed with coaxial holes so as to permit another member to penetrate through the inner parts of the respective coils and the core in a direction orthogonal to the main magnetic fluxes of the coils, thereby to facilitate the combination of the ignition coil device with another device having a rotary shaft, a housing for supporting the rotary shaft, etc. and to reduce the size of the whole structure.

BRIEF DESCRIPTION OF THE DRAWINGS

In the drawings, the same symbols indicate the same or corresponding parts.

DESCRIPTION OF THE PREFERRED EMBODIMENT

Figure 1:
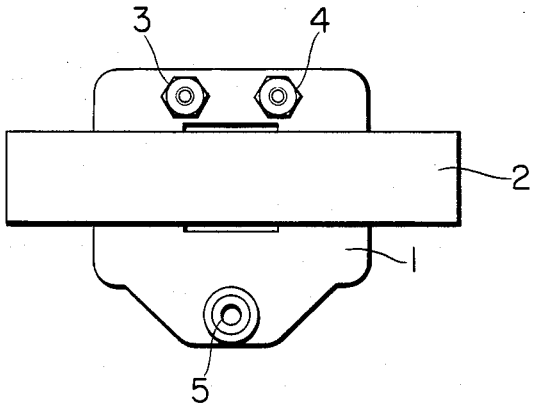
FIG. 1 PRIOR ART
FIGS. 1 and 2 are a plan view and a sectional side view showing a prior-art ignition coil device, respectively.
Figure 2:
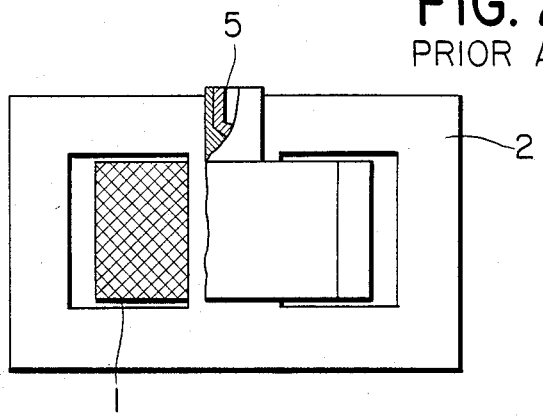
FIG. 2 PRIOR ART
Figure 3:
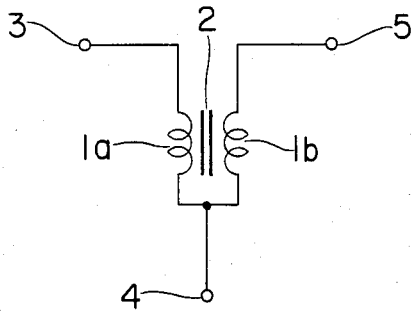
FIG. 3 is an equivalent electric circuit diagram of a general ignition coil.
Figure 4:
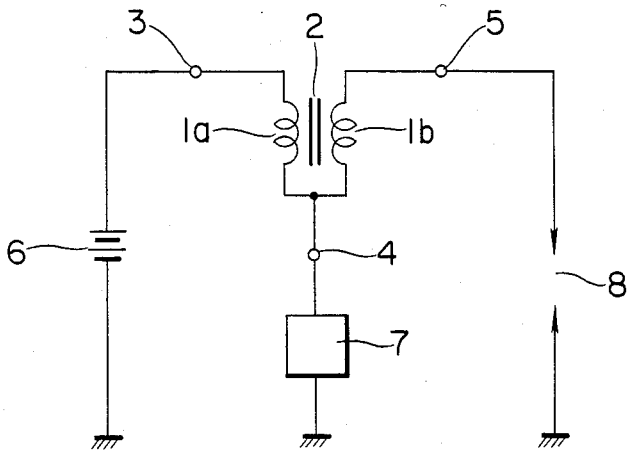
FIG. 4 is an electric circuit diagram of a general ignition device for an internal combustion engine.
Figure 5:
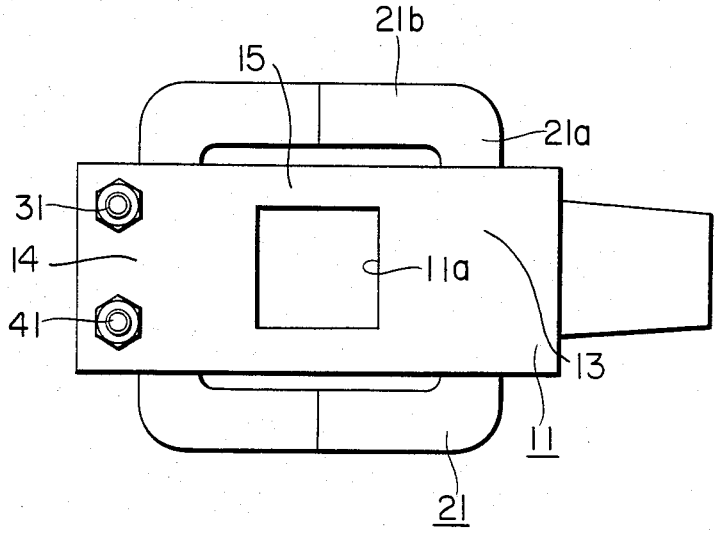
FIGS. 5 and 6 are plan view and a sectional side view showing an ignition coil device according to an embodiment of the present invention, respectively.
Figure 6:
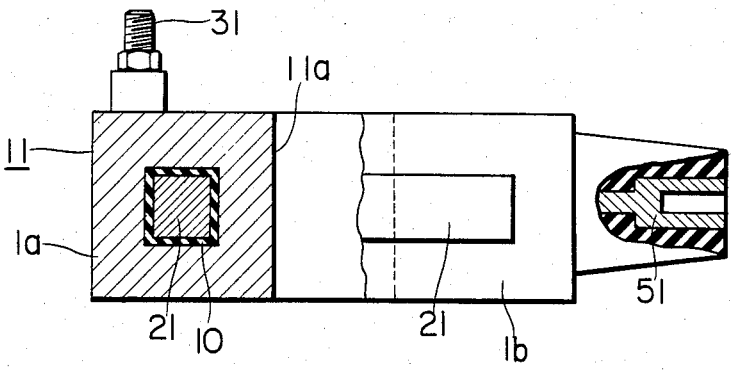

An embodiment of this invention will be described with reference to FIGS. 5 and 6. FIGS. 5 and 6 show one embodiment of the present invention. Referring to the figures, numeral 11 designates a coil assembly in which a primary coil 1*a* and a secondary coil 1*b* wound in a manner to be insulated from each other are covered with a molding material having an insulating property, such as polypropylene. The coil assembly 11 comprises coils 1*a* and 1*b* and a coupling portion 15, the coils 1*a* and 1*b* being covered by molding material which has an insulating property and which also forms the coupling portion, the molding material portions 13, 14 and 15 comprising one integral piece, namely, the coil assembly 11. The coils are wound in a manner to be respectively arranged on the right and left sides of the coil assembly, the middle part of which is formed with the coil aperture 11*a* through which a member to be inserted, not shown, such as the rotary shaft of a distributor can penetrate is located between the right and left coils 13,14. A core 21 forms a magnetic path which is common to the primary coil 1*a* and secondary coil 1*b* wound in the coil assembly 11, illustrated in FIG. 5 as a four-sided ring, defining the core aperture 21*c* by its inside surface, so constructed that the member to be inserted can penetrate through core aperture 21*c*, which is preferably coaxial with the coil aperture 11*a*. The core 21 comprises two U-shaped core members each of which includes a leg portion 21*a*, and connecting portions 21*b*, which protrude from both the ends of the leg portion 21*a* in the same direction. The two core members are coupled by butting the corresponding connecting portions to each other. Numeral 31 designates a terminal which is connected to one end of the primary coil 1*a*, numeral 41 a terminal which is connected to the other end of the primary coil 1*a* and one end of the secondary coil 1*b* in common, and numeral 51 a high-voltage terminal which is connected to the other end of the secondary coil 1*b*. The terminal 31, the terminal 41 and the high-voltage terminal 51 are fastened integrally to the coil assembly 11 by a molding material. Shown at numeral 10 is a resin coil bobbin for insulation of said coils from said core.

Changes in magnetic fluxes caused by the interruption of current through the primary coil 1*a* induces a high voltage in the secondary coil 1*b* in the core 21. In the present invention, besides the above function as the ignition coil, the ignition coil device has the function that the member to be inserted such as the rotary shaft of the distributor can penetrate inside the coils in a direction perpendicular to the main magnetic fluxes of the coils.

While, in the embodiment, the core 21 has been illustrated as being split into the plurality of parts, it may have any shape adapted to form a magnetic path, for example, an annular shape. In addition, while the coil aperture 11*a* formed in the coil assembly 11 has been illustrated as a square, it may well be in any other shape (for example, a circular shape).

As set forth above, according to this invention, an ignition coil device is so constructed that a member to be inserted can penetrate inside an ignition coil. Therefore, the combination of the ignition coil device with another device is facilitated, and the whole structure can be balanced and reduced in size.

What is claimed is:

1. An ignition coil device for an internal combustion engine comprising:

a core including two U-shaped core parts, each of which has a pair of connecting portions protruding from the ends of a leg portion in the same direction, and said two core parts being connected by butting the ends of corresponding connecting portions;

said core defining a core aperture surrounded by said leg portions and said connecting portions;

a coil assembly including coils wound on said leg portions of said core;

said coil assembly having a molding material with an insulating property which is formed so as to cover said coils therein;

said coil assembly further having molding material which is formed so as to provide a coupling portion connecting said coils and extending within said coil aperture, said coupling portion of molding material and said molding material which covers said coils being integral to maintain said coils in assembled relationship and said core parts in abutting relationship and having a coil aperture extending through said coupling portion coaxially with said core aperture; and said coils being used for generating a high voltage for activating spark plugs.

2. An ignition coil device for an internal combustion engine as defined in claim 1, wherein said coil parts consist of a primary coil and a secondary coil for generating a high voltage for producing sparks, and said primary coil and said secondary coil being wound on respective of said leg portions.

3. An ignition coil device for an internal combustion engine as defined in claim 2, comprising a common terminal which connects one end of said primary coil and one end of said secondary coil, a primary coil terminal which is connected to the other end of said primary coil, and a secondary coil terminal which is connected to the other end of said secondary coil.

4. An ignition coil device for an internal combustion engine as defined in claim 3, wherein said common terminal and said primary coil terminal are disposed on an upper surface of said coil assembly, and said secondary coil terminal is disposed on a side surface of said coil assembly.

* * * * *